US010160025B2

(12) United States Patent
Roscher et al.

(10) Patent No.: US 10,160,025 B2
(45) Date of Patent: Dec. 25, 2018

(54) DEEP DRAWING DIE AND METHOD FOR DEEP DRAWING A WORKPIECE

(71) Applicant: Audi AG, Ingolstadt (DE)

(72) Inventors: Hans-Jürgen Roscher, Thum-Jahnsbach (DE); Klaus Wolf, Chemnitz (DE); Patrick Mainda, Arnsberg (DE); Matthias Kerschner, Rohrbach (DE)

(73) Assignee: Audi AG, Ingolstadt (DE)

( * ) Notice: Subject to any disclaimer, the term of this patent is extended or adjusted under 35 U.S.C. 154(b) by 147 days.

(21) Appl. No.: 14/663,844

(22) Filed: Mar. 20, 2015

(65) Prior Publication Data

US 2015/0202675 A1 Jul. 23, 2015

Related U.S. Application Data

(63) Continuation of application No. PCT/EP2013/002384, filed on Aug. 8, 2013.

(30) Foreign Application Priority Data

Sep. 20, 2012 (DE) ..... 10 2012 018 606

(51) Int. Cl.
*B21D 22/20* (2006.01)
*B21D 24/10* (2006.01)
*B21D 24/04* (2006.01)

(52) U.S. Cl.
CPC ..... *B21D 24/10* (2013.01); *B21D 22/20* (2013.01); *B21D 24/04* (2013.01)

(58) Field of Classification Search
CPC ..... B21D 22/02; B21D 22/06; B21D 22/20; B21D 22/22; B21D 24/04; B21D 24/08;
(Continued)

(56) References Cited

U.S. PATENT DOCUMENTS 1,884,700 A * 10/1932 Hothersall ..... B21D 24/08 72/329
4,745,792 A * 5/1988 Story ..... B21D 22/22 72/351

(Continued)

FOREIGN PATENT DOCUMENTS

DE 19901019 A1 * 1/1999 ..... B21D 24/08
DE 19756232 C1 7/1999

(Continued)

OTHER PUBLICATIONS

Translation, DE 102007033943 A1, Jan. 2009.*

(Continued)

*Primary Examiner* — Edward Tolan
(74) *Attorney, Agent, or Firm* — Panitch Schwarze Belisario & Nadel LLP

(57) ABSTRACT

A deep drawing die is provided having a top die with a hold-down clamp, a bottom die with a die plate, and at least one device arranged in a flange region, by which the distance between the hold-down clamp and the die plate can be modified in portions or partially. A method for deep drawing a workpiece with a deep drawing die includes inserting a workpiece between top and bottom dies, deep drawing by closing the dies, and controlling at least one actuator to generate a holding force during deep drawing. By selectively increasing forces in the flange feed at selected locations between hold-down clamp and die plate, it is possible to control the flow of material into the die plate and relieve load on regions having high deforming work, so that tears or cracks at these points in the finished component can be prevented.

11 Claims, 2 Drawing Sheets

(58) Field of Classification Search
CPC ..... B21D 24/10; B21D 24/12; B21D 24/14; B21D 24/02
See application file for complete search history.

(56) References Cited

U.S. PATENT DOCUMENTS

| | | | | | |
|---|---|---|---|---|---|
| 5,095,725 | A * | 3/1992 | Wada | B21D 28/002 | 310/328 |
| 5,269,163 | A * | 12/1993 | Yagi | B30B 15/0041 | 100/99 |
| 5,477,723 | A * | 12/1995 | Kergen | B21D 24/08 | 72/347 |
| 5,979,211 | A * | 11/1999 | Pahl | B21D 22/22 | 72/351 |
| 6,237,381 | B1 * | 5/2001 | Smedberg | B21D 24/08 | 100/259 |
| 6,276,185 | B1 * | 8/2001 | Owens | B21D 22/22 | 72/350 |
| 6,691,545 | B1 * | 2/2004 | Aagaard | B21D 22/22 | 72/347 |
| 6,851,355 | B2 * | 2/2005 | Harada | B29C 43/361 | 100/269.01 |
| 7,891,075 | B2 * | 2/2011 | Mankame | B23Q 3/086 | 148/402 |
| 8,943,870 | B2 * | 2/2015 | Rouweler | B21D 5/0209 | 72/481.1 |
| 8,992,239 | B2 | 3/2015 | Furuya et al. | | |
| 9,174,261 | B2 * | 11/2015 | Matsuda | B21D 22/22 | |
| 2012/0255337 | A1 | 10/2012 | Matsuda et al. | | |
| 2012/0318034 | A1 * | 12/2012 | Moore | B21D 22/06 | 72/338 |
| 2012/0324974 | A1 * | 12/2012 | Nakamura | B21D 22/22 | 72/305 |
| 2013/0224974 | A1 | 8/2013 | Furuya et al. | | |

FOREIGN PATENT DOCUMENTS

| | | | | |
|---|---|---|---|---|
| DE | 19805706 | A1 | 8/1999 | |
| DE | 19902741 | A1 * | 7/2000 | B21D 22/22 |
| DE | 19954310 | A1 | 5/2001 | |
| DE | 10331939 | A1 | 2/2005 | |
| DE | 102006031438 | A1 | 1/2008 | |
| DE | 102007033943 | A1 * | 1/2009 | B21D 24/02 |
| EP | 1593443 | A1 | 11/2005 | |
| JP | 2002-343169 | A | 11/2002 | |

OTHER PUBLICATIONS

Translation, DE 19901019 A1, Jan. 1999.*
Translation DE 19902741 A1, Jul. 2000.*
Translation DE 19954310, May 2001.*
Office Action dated Jul. 14, 2016 in CN Application No. 201380049141.6.
Office Action dated May 15, 2013 in DE Application No. 10 2012 018 606.1.
International Search Report dated Sep. 24, 2013 in International Application No. PCT/EP2013/002384.
Office Action dated Nov. 27, 2015 in CN Application No. 201380049141.6.
Office Action dated Jan. 31, 2018 in DE Application No. 10 2012 018 606.1.

* cited by examiner

DEEP DRAWING DIE AND METHOD FOR DEEP DRAWING A WORKPIECE

CROSS-REFERENCE TO RELATED APPLICATIONS

This application is a Continuation of International Application No. PCT/EP2013/002384, filed Aug. 8, 2013, which was published in the German language on Mar. 27, 2014, under International Publication No. WO 2014/044338 A1, and the disclosure of which is incorporated herein by reference.

BACKGROUND OF THE INVENTION

The invention relates to a deep drawing die having a top die and a bottom die, wherein the top die has a hold-down clamp and the bottom die has a die plate. The invention further relates to a method for deep drawing a workpiece using a deep drawing die.

Deep drawing is tensile-compressive forming of a plate or sheet metal to form a hollow body, or a pre-drawn hollow body is deformed to become such having a smaller cross-section. Both usually occur without any intended change to the sheet metal thickness. Round, oval and also angular cross-sections of components can be realized by use of deep drawing. The scope of deep-drawn parts ranges from small components having large drawing depth, e.g. beverage cans, to large-area components having different drawing depths, e.g. body parts of a motor vehicle.

In general, a deep drawing die comprises a top die having a punch and a hold-down clamp, as well as a bottom die having a die plate. A flat sheet metal plate is first positioned on the die plate, whereupon the top die moves in the direction of the bottom die. Once the top die contacts the sheet metal plate, a holding force is exerted on the plate by the hold-down clamp, where the drawing punch moves from the top die into the bottom die or into the die plate further downwardly and forms the plate into a cup-shaped deep-drawn part, for example.

The hold-down clamp serves to subject the sheet metal plate to a holding force during the forming process, such that wrinkling of the sheet metal due to tensile-compressive stresses in the sheet metal plate is prevented in the region between the hold-down clamp and the die plate. However, the holding force is selected such that the flow of material in the direction of the punch is not prevented.

The force for forming the sheet metal plate is transmitted from the punch to the base of the part to be deep-drawn into the flange of the sheet metal plate located between the draw ring and the hold-down clamp. The material of the sheet metal plate there flows in over the edge of the die plate or the draw ring from the edge of the plate or the flange, whereby the outer circumference is reduced.

The deep drawing process and the forming process are completed when the punch has reached its defined position within the die plate. Thereafter, the punch and the hold-down clamp or the top die return to their original positions. The base of the formed sheet metal plate has the original sheet thickness, where the cup wall has been stretched and the flange has been compressed.

In summary, the forming process takes place under the action of radial tensile and tangential compression stress, where the compression stress is caused by the excess material which would bring the flange to buckle if no hold-down clamp were provided.

Due to increasingly shorter product cycles and due to the increasing complexity of components and of assemblies in terms of shape, the aim is largely to eliminate in advance any process fluctuations in the complex process of deep drawing, so that rejects of parts in series operation is kept low and long periods in the start-up of production can be avoided.

Furthermore, for reasons of costs, it is the aim from an energy perspective to form thin-walled sheet metal plates.

Despite numerical simulation of forming processes, problems arise during the real implementation which generally result in an improvement of the tool or the die plate and are therefore costly. The reject rate of deep-drawn components also increases due to the increasing complexity of the components and the shorter product cycles.

It happens, for example, in particular with die plates having complex shapes, that forming stresses, arising when deep drawing the sheet metal plate, are so great that the material of the sheet metal plate is thinned by the forming process such that cracks or tears occur.

The requirements in terms of deep drawing complex components from thin-walled sheet metal plates seem to lie in opposite directions.

BRIEF SUMMARY OF THE INVENTION

The invention is therefore based on the object of providing a deep drawing die that enables influencing the material of a plate while deforming/deep drawing or that enables configuring the flow characteristics of a plate to be deformed in a controllable manner.

The invention is further based on the object of providing a method for deep drawing a plate that enables influencing the flow characteristics of a plate during deep drawing and minimizing costs by reducing reject components.

Regarding the deep drawing die according to the invention, the aforementioned objects are achieved by a deep drawing die having a top die and a bottom die, wherein the top die has a hold-down clamp and the bottom die has a die plate, and having a device for modifying a distance between the hold-down clamp and the die plate at least at a portion thereof which is arranged between the hold-down clamp and the die plate.

Regarding the method for deep drawing a plate according to the invention, the aforementioned objects are achieved by a method for deep drawing a workpiece with a deep drawing die as described above, the method comprises the steps of: (a) inserting a workpiece between the top die and the bottom die; and (b) deep drawing a plate by closing the top and the bottom dies; (c) wherein a holding force is introduced by at least one actuator in at least one portion between the top die and the bottom die during the deep drawing.

The invention is preferably guided by the idea of making it possible to control the flange feed of a workpiece by pressure distributions which are adjustable in the forming process.

According to a first aspect of the invention, it is advantageously provided that a deep drawing die comprises a top die and a bottom die, where the top die advantageously has a hold-down clamp and the bottom die advantageously has a die plate.

With the help of the hold-down clamp or the die plate, a workpiece or a plate, respectively, can be held in position for a deep drawing process. A holding force being applied by the hold-down clamp to the plate and thereby to the die plate is selected such that the material of the plate being held between the hold-down clamp and the die plate can flow into the die plate during the forming process. The region of the plate arranged between the hold-down clamp and the die plate is also referred to as the flange, which—as already mentioned—flows into the die plate during deep drawing. The flange or the region between the hold-down clamp and the die plate extends around the entire plate in the circumferential direction and forms the edge of the deep drawing die.

Advantageously, at least one device is arranged in a portion between the hold-down clamp and the die plate, with which the distance between the hold-down clamp and the die plate can be modified in the portion.

By modifying the distance, a holding force having lesser or greater intensity in the at least one portion can be generated by the hold-down clamp onto a plate and thus also onto the die plate, whereby the feed of the flange of the plate into the die plate is controllable. The force can logically also be generated starting from the die plate onto the plate and then onto the hold-down clamp.

In other words, by the adjustable force of the hold-down clamp and/or the die plate, pressure can be generated or reduced in the forming process in the at least one portion onto the plate and change the flow characteristics in the portion subjected to more or less pressure. Consequently, also the flow characteristics of the regions of the plate located around the at least one portion are thereby affected. For while the flow, for example in the at least one portion, is prevented or hindered by greater holding force, more material must flow from the surrounding regions. Consequently, the flow characteristics of the plate can be controlled during a deep drawing process by the skillful arrangement of the at least one device.

Due to the modification of the distance in the at least one portion, the holding force is varied on the one hand, but essentially the friction between the plate and the top die or the hold-down clamp and also between the plate and the bottom die or the die plate, respectively.

The at least one portion is advantageously a section/part of the area that is defined between the hold-down clamp and the die plate. It is therefore the portion that clamps the plate or that prevents the formation of wrinkles on the drawing part.

It is further advantageous to have the at least one device be disposed within the top die and/or the bottom die. Consequently, a plate is not already deformed when closing the deep drawing die, whereby no additional forces act upon the plate before they are specifically applied.

For the at least one device to be disposable within the top die and/or the bottom die, it is favorable if the top die and/or the bottom die have a seat. The at least one device can be held in this seat in a positive-fit, force-fit and/or positive substance-fit manner in the bottom die and/or the top die. In the event of failure of the at least one device, it is thereby easy to replace the latter and exchange it for a new one or repair the defective device and reconnect it with the die.

A positive-fit connection between the at least one device and the top die and/or the bottom die can be realized, for example, by a dovetail connection, a gear coupling, a tongue and groove connection or a feather key. A positive-fit connection is possible, for example, by a screw connection and/or by spring clips. The positive substance-fit connections can be realized by soldering, welding and/or gluing.

It is advantageous to have the seat be formed by the surface of the top die and/or the bottom die. By use of the aforementioned types of connections, the at least one device can thereby be inserted into the surface or into the top die or the bottom die.

It is of course also possible that the at least one device be arranged in the respective die. That is, it is favorable for the at least one device to be arranged closely below the surface of the hold-down clamp and/or the die plate. The at least one device is preferably arranged closely beside the side or surface of the top die and/or the bottom die on which the plate to be formed rests.

In this manner, the at least one device does not contact the plate, but can deform the surface of the bottom die or the top die facing a plate, whereby additional holding force is generated onto the plate.

Consequently, a force can be applied indirectly to a plate, where one or a few intermediate elements can be arranged between the plate and the at least one device, such as a section of the bottom die or the top die.

It is further advantageous to have a surface of the at least one device connect to a surface of the top die or the bottom die at the same level. At the same level in this context means that there is no difference between the surface of the respective die and the at least one device, i.e., a planar surface can be realized and no difference in height is given between the two, respectively. In other words, the surfaces of the at least one device and the surface of the bottom die or the top die form a common planar surface for a plate. In this manner, the at least one device is in direct contact with the plate.

This ensures good accessibility for maintenance and replacement of the device. Further, a maximum force can thereby be applied to the portion of the plate in which the at least one device is arranged. Consequently, a force exerted onto a plate by the at least one device can be applied directly without losses due to friction. This increases, for example, energy efficiency of such an arrangement.

The term "within" can hereinafter be understood in that the at least one device is disposed within the top die or the bottom die, such that it directly or indirectly contacts the plate.

A region of the at least one device adjoining the top die or the bottom die is favorably at the same level as the top die or the bottom die. Here, at the same level has the meaning as already explained above, where preferably the adjoining region and the transition from the at least one device to the deep drawing die or vice versa is formed steplessly. This configuration is advantageous, for example, for an attachment area of the adapter.

However, an oscillation region of the adapter can have any shape, such as a concave and/or convex curvature. Other shapes or profiles of the surface of the oscillation region of the adapter are of course also conceivable, such as a zigzag-shaped profile.

Preferably, the at least one device is arranged in the top die and/or the bottom die in locations where and/or near which cracks/tears or other damages are to be expected in the finished component. In this manner, the flow characteristics of the material of the plate can be favorably influenced.

The at least one device can be of any shape such as a rectangular, square, oval, circular, and/or a polygonal shape. Here, it is possible that the at least one device be arranged longitudinally and/or transversely relative to the hold-down clamp and/or to the die plate. That is, any shape of the at least one device can be arranged having any orientation in the top die and/or the bottom die.

It is thus possible to have the at least one device extend in a diagonal serpentine, wavy, meander-shaped, and/or in zigzag form. It has also shown to be advantageous to attach the at least one device in a star-shape or circumferentially in the region of the flange in the top die and/or the bottom die.

Also, the at least one device can be arranged in the entire region between the hold-down clamp and the die plate, i.e. in the entire flange region. Material inflow can in this manner be optimally controlled during deep drawing.

It is in this manner also possible to modify the force between the hold-down clamp and the plate die in selected regions (sectionally) or in the at least one portion. Thus, by reducing the distance between the hold-down clamp and the die plate, a plate or its material, respectively, can be prevented from flowing, and the adjoining region adjacent to the region having a reduced distance can be encouraged to increase flowing. In effect, the flow characteristics of the workpiece or the plate during a deep drawing process can thereby be controlled at certain locations, i.e. individually for selected portions.

Moreover, the holding force in the at least one portion, in which the at least one device is arranged, can during the deep drawing be adapted and modified. As a consequence, the holding force can be controlled in different phases or at different locations of the punch, so that, for example, at the beginning of the deep drawing operation, no additional holding force is generated by the at least one device. Furthermore, approximately in the middle of the entire process the load on the at least one portion can be relieved, so that the material flows better in a certain region within the die plate, whereas at the end, when the degree of formation is the highest, the flow characteristics can be controlled or modified by an additional holding force to the extent, for example, that less material flows from the at least one portion. Accordingly, the flowing process in the flange feed, i.e. between the hold-down clamp and the die plate, is thereby influenced, such that the flange regions having high forming loads during deep drawing can be relieved of load, so that production errors such as tears can be preventable in the fully formed component.

It is particularly preferred if the distance between hold-down clamp and the die plate can be modified in regions which are close to highly loaded deforming regions. In this manner, it can also be avoided to have material flowing from a region having high deforming work, so that therefore more material remains at the points of the high forming loads, whereby they are relieved of load.

In other words, modifying the distance between the hold-down clamp and the die plate or modifying the holding force in the at least one portion, respectively, prevents material of the plate from flowing or encourages flowing, so that material flows from other regions, whereby highly loaded regions can be relieved of load.

By modifying the distance between the hold-down clamp and the plate die, the holding force or the pressure to/in selected regions or in portions between the hold-down clamp and the plate die is consequently modified in sections.

The at least one device preferably comprises at least one actuator. The latter is conveniently configured as a piezoelectric actuator. Piezoelectric actuators are electromechanical transformers for both transformation directions, i.e., for lengthening and shortening distance, while they produce forces in doing so. The mode of operation is fully described in specialist literature. With a sufficiently rigid connection to a site of action in a manufacturing facility, forces can be generated, with relatively small expansions generated by a voltage or applied charge, in process-relevant directions.

It is further advantageous to have the at least one device generating a holding force in a deep drawing die comprise a base plate, an adapter and at least one actuator, where the at least one actuator is disposed between the adapter and the base plate.

With regard to the base plate, it is advantageous to have it be composed of modules. Assuming that piezoelectric actuators are used for the at least one actuator, this is advantageous because piezoelectric actuators are, after their shaping production step, subjected to polarization for initiating the electromechanical properties. After polarization the actuators then have different lengths. For a uniform force of several actuators to be able to be transmitted from the base plate to the adapter, it is necessary to select the piezoelectric actuators according to length and expandability by allocating them to classes.

For using as many classes as possible, it is preferred to set up actuators of one class on a strip-shaped module. The individual modules or strips from which the base plate is assembled are advantageously connectable to each other. The connection is advantageously effected in a positive-fit, force-fit and/or a positive substance-fit manner.

In order, for example, to easily replace a defective actuator, it is preferred to have a module or a strip be bolted respectively to other modules or strips. Bolting the strip-shaped base plates is a practical and simple solution to facilitate the repair of a device, because only the module having the defective actuators must be replaced, thereby saving costs.

Due to the aforementioned embodiment of a base plate having modules on which actuators are arranged, an uneven surface can form on the side of the base plate facing away from the actuators.

It is therefore preferable to level the base plate composed of modules, at least at this side, to create a uniform, planar, level surface. This is favorable for a planar contact surface for support in the deep drawing die or in the bottom die or the top die. Such a surface, after assembly of the assembled strip-shaped modules to form a base plate, can be effected, for example, by machining the underside, i.e. the side which is facing away from the actuators. It is advantageous for such a machining process to choose a metal-cutting process, such as face milling and/or surface grinding.

By creating a plane-parallel contact surface for support in the deep drawing tool, grinding over the piezoelectric actuators can be avoided as an alternative solution. This is problematic, in particular, due to the effort for preventing mechanical stress and also due to the risk of contamination.

It is furthermore also possible to create a common planar underside of the modules joined to form a strip-shaped base plate by leveling with a high-strength casting compound.

It is of course also possible to use a base plate which is integrally formed, instead of a base plate which is divisible or of a modular configuration.

With regard to the arrangement of at least one actuator within the at least one device or between the adapter and the base plate, it is advantageous to have a plurality of actuators be arranged consecutively.

The plurality of actuators is advantageously arranged in at least one row and/or at least one column on the base plate. The at least one device, with the aid of such an arrangement, can be precisely adapted and positioned according to the case of need within the bottom die and/or the top die. Any shape of the at least one device can thereby be realized in a simple manner.

Individual forces generated by different actuators can be combined by use of the adapter, whereby differences of the forces generated can be compensated. Failure of individual actuators or a power reduction can thereby also be compensated. In addition, the adapter can combine the forces of the individual actuators and pass them on as a total force.

The arrangement of the adapter and the base plate, between which at least one actuator is attached, can be completed in a simple manner to form a protective casing. The at least one actuator can therewith be protected from oil and grease, which during deep drawing favorably influence the friction between the hold-down clamp and the punch. Short circuits can be avoided in the electrical connections of the actuators as a result, when they are designed as piezo-electric actuators.

To protect the at least one device from influences such as oils or greases, it is advantageous to have the adapter, the base plate and a frame encapsulate the at least one actuator. Accordingly, the aforementioned protective casing can be created. Here, it is preferred to have the frame be arranged between the adapter and the base plate to form a housing or a casing.

The adapter preferably has at least one flexure hinge. Here, it is advantageous to have this flexure hinge disposed between a fastening and an oscillation region of the adapter, where both regions are movable relative to each other. In this manner it is possible to configure a wear-resistant joint that transmits forces of actuators without losses. Furthermore, such a flexure hinge requires low maintenance and is durable.

The adaptor or its attachment region advantageously secures the flexure hinge against a transverse or lateral motion, while at the same time providing movability in the lateral or transverse direction.

A flexure hinge is not a conventional joint, whereby its mobility is based instead on elastostatics. With such a hinge, the function is provided by a region of reduced flexural rigidity, being located between two adjacent regions having comparatively higher flexural rigidity, where all three parts are connected to each other and are generally comprised of uniform material. A guide for the moving region or the oscillation region can be realized at the same time by use of such a flexure hinge. This is favorable because a further component for this function can be dispensed with, and the necessity to provide maintenance for a guide with lubricants, for example, is thereby eliminated.

Due to the fact that a flexure hinge can move both away and toward the at least one actuator, it is advantageous to have the at least one device comprise at least one stop. Ideally, this stop sets a minimum distance between the adapter and base plate, so that effective overload protection for the at least one actuator is obtained. In this manner, forces can be effectively supported in the direction of the at least one actuator, so that the durability of the at least one actuator is ensured. When using piezoelectric actuators, a largely uniform mechanical minimum preload can also be applied to the piezoelectric actuators by use of a flexure hinge. Immediate force transmission by the piezoelectric actuator can be ensured in this manner.

The frame and/or the base plate ideally comprises the at least one stop. Here, it is advantageous for a specific embodiment of the at least one stop to have the frame comprise a shoulder against which the oscillation region of the adapter can bear, without the at least one actuator suffering any mechanical damage.

Moreover, it is advantageous to have the base plate comprise the at least one stop. It can be specifically configured to be similar to that of the at least one actuator, but exhibit greater rigidity to protect the at least one actuator from overload. A combination of stops is of course possible, i.e. at least one stop is arranged on the frame and at least one stop on the base plate.

Preferably, the holding force of the at least one device is controllable. In this manner, it is possible to regulate the force that is generated by the at least one device in a continuously modifiable manner. The inflow of the plate or the flange region of the plate can thereby be regulated, such that so-called tears or cracks in the deformed plate can be avoided. Can be regulated presently means that at least one device can both generate an additional holding force, but can also reduce the holding force of the hold-down clamp or the top die onto the plate.

By use of the at least one device or its at least one actuator when employing piezo-electric actuators, it is also possible to have a holding force from the piezoelectric actuators not only act upon the plate, but also at the same time to detect the holding force and thereby to draw conclusions about the flow characteristics at selected locations within the deep drawing die.

It is further advantageous for each actuator to have a series resistor that protects against rapid discharge and is preferably connected in series to the actuator. It is furthermore advantageous if a defective actuator is disconnected from a supply line that supplies electric power to each actuator.

The requirement for sufficient availability is advantageously also satisfied in an ongoing deep drawing process in that each individual actuator is protected against excessive rapid discharge by a sufficiently sized series resistor, and that this series resistor is further sized and configured such that it preferably acts as a so-called safety resistor and reliably separates the defective actuator from a power supply line.

Furthermore, it is preferred to have this resistor be sized so small that it has a minor influence on the dynamics of the control behavior by an electrical actuation, and that the charging and discharging currents caused by the control do not trigger the safety function. Protecting the individual actuator by electronic means, such as current limitation and management for reducing the current for reasons of power loss, is more complex.

If the series resistors are disposed within the at least one device for reasons of compactness, then it is preferable by providing a suitable configuration in terms of insulation to prevent the passage of hot particles of the resistor or of the defective actuator in the event of failure from possibly being flung onto adjacent piezoelectric actuators.

This task of insulation is advantageously performed by absorbent material, that can ideally at the same time absorb moisture.

It is furthermore preferable to ensure continued operation of at least one device in case of failure of individual actuators. Here, a simple, direct parallel connection of piezoelectric individual actuators within the at least one device does not make sense for physical reasons, because the at least one controlled device stores a significant amount of electrical energy, since each piezoelectric actuator also represents an electrical capacitance to be charged.

Therefore, it is preferred to interconnect a series-connected arrangement of at least one actuator and one series resistor in parallel with further arrangements, in particular also with at least one actuator and one series resistor. This means that any number of arrangements are connected in parallel, where each arrangement preferably comprises at least one actuator and one series resistor, and where the at least one actuator and the series resistor are conveniently connected in series.

It is furthermore advantageous if a control device can be power-limited at least for self-protection. A defective piezo-electric actuator generally has a short circuit, whereby the overall charge discharged into the defective actuator from actuators directly electrically connected in parallel promotes and accelerates further short circuiting. Due to current limitation or due to capacity limitation of the control unit, the electrical voltage at all actuators very quickly breaks down in the event of a short circuit, which in consequence results in mechanical loads caused by voltage peaks arising in the piezoelectric actuators which exceed the allowed limits. This can therefore reduce the life of the actuators. With mechanical preload of the actuators, that are kept relatively low for reasons of technical application, a chain reaction of the sequence of mechanical and electrical damage was also observed.

Another advantageous measure for ensuring adequate availability of at least one device is the division into functional groups, such that upon failure of the power supply of one group of actuators, the operational groups entirely or with reasonable reduction take over the loss of actuating force.

The exertion of the individual forces to the total force by the adapter described above supports this. A simple example of this arrangement is the parallel arrangement of several rows of actuators, where each row is powered by a dedicated power supply unit. This configuration is advantageous also to the effect that the power supply units delivering the respective partial power, due to the smaller volume of construction, can be placed in the tool insert or near the deep drawing die with fixed wiring. This achieves minimization of cable leads to the tool or to the at least one device. Furthermore, the power supply units can thereby be arranged decentralized and preferably be interconnected in terms of their energy recovery.

Power supply units having the capability of receiving electrical and electro-mechanically converted actuator energy are advantageously used.

Since at least one device and also the deep drawing die can contain a plurality of actuators (at least one actuator), it is advantageous to interlink and interconnect all or a portion of the power supply units assigned to different places of action in the deep drawing die. This has the advantage that energy generated from a mechanical-electrical conversion process in one place of action can be distributed to power supply units for other places of action, whereby the effort of buffering power peaks can be reduced.

In a second aspect of the invention, it is preferably intended to provide a method for deep drawing a workpiece with a deep drawing die comprising the following steps:

In one method step, a plate is preferably inserted between a top die and a bottom die. The workpiece or the plate to be deep-drawn can be positioned within the deep drawing die comprising the top die and the bottom die.

In a further step, it is advantageous to have the plate deep-drawn by closing the top die and the bottom die. In this manner, the flat workpiece or the flat plate is deformed three-dimensionally.

In a further step, a holding force is advantageously introduced during deep drawing by at least one actuator, in particular by a piezoelectric actuator. The material flowing into the die plate can be controlled in this manner, whereby regions of high deforming work can be selectively relieved of load. Due to the increase in friction between the hold-down clamp and the die plate or in the flange region, respectively, the flow of material of the plate is locally delayed at the point having the generated holding force, so that material from other locations must flow in. By introducing the holding force, it is also possible to influence the actuators or the holding force that they generate in dependence on the position of the punch and/or the degree of deformation.

It is of course also possible additionally to reduce the friction. This can be done, for example, by reducing the holding force in the flange region. This can consequently enhance faster flow of material of the plate.

It is further advantageous to have the holding force be generated in at least one portion between the top die and the bottom die. Different forces can therefore be applied to different regions, whereby the flow characteristics can be influenced during deep drawing at and around the at least one portion.

At least one device is preferably arranged in the at least one portion between the hold-down clamp and the die plate or between the top die and the bottom die and preferably comprises at least one actuator and modifies the distance between the hold-down clamp and the die plate in the at least one portion. Different holding forces can easily be generated in this manner by the at least one device.

It is furthermore advantageous to have the holding force of the at least one actuator be controlled during deep drawing. Detection and regulation of the forces applied are thereby also possible in addition to the application of a holding force, in particular when using piezoelectric actuators. Consequently, the holding force can be changeably controlled or regulated. In other words, it is possible to modify the at least one actuator or the at least one device during the duration of the deep drawing process, such that different amounts of the holding force generated can be realized at different locations of the punch of the top die.

It is furthermore advantageous to have the holding force of the at least one actuator be controlled during deep drawing. In controlling, the actuators are also used as sensors, so that the holding force can be influenced in dependence on the position of the punch and/or the degree of deformation.

Basically, the at least one device can be operated in a controlled manner, i.e. preferably without a measuring system for feeding a plate. The at least one device can of course be operated in a controlled and/or regulated manner.

The device and/or the deep drawing die favorably comprise at least one measuring system for measuring plate movement. This makes a reaction or regulation possible during feeding.

The features described above, which all serve the formation of a deep drawing die and a method for deep drawing a workpiece, can be combined freely with one another. The features of the device can also be combined with the deep drawing die presented and the method presented.

It is advantageous to use metals as material for the plates mentioned, in particular sheet metal, or plastics of all types that are suitable for the process of deep drawing.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
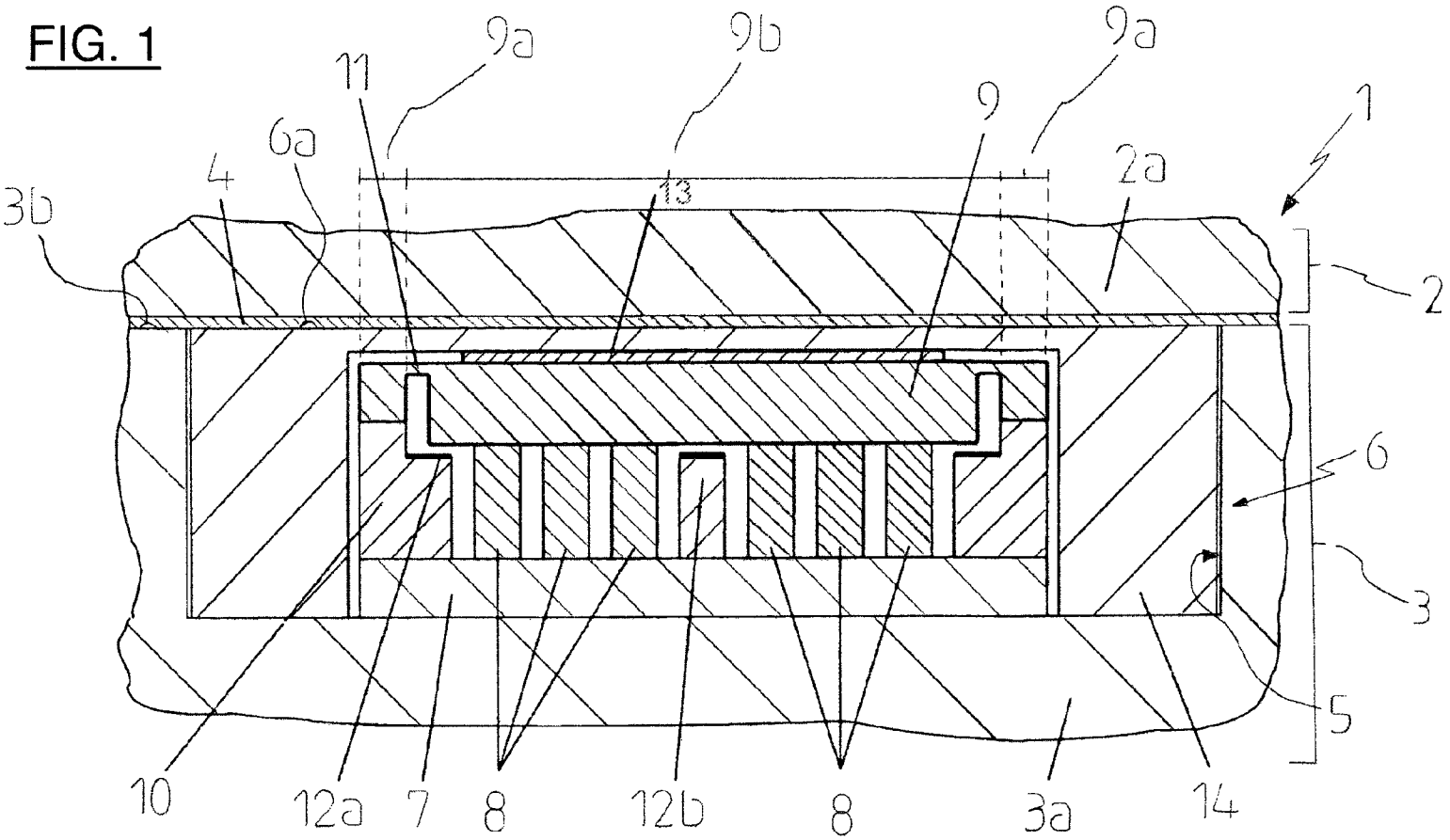
FIG. 1 is a schematic, sectional side view through a deep drawing die according to a first embodiment of the invention.

FIG. 1 is a sectional side view showing a deep drawing die 1 comprising a top die 2 and a bottom die 3. The top die 2 comprises a hold-down clamp 2*a*, subjecting a sheet metal plate, being disposed between the top die 2 and the bottom die 3, to a holding force.

Bottom die 3 comprises a die plate 3*a*, in which a seat 5 for a device 6 is arranged, where the device can generate and modify additional holding force in the deep drawing die 1. The seat 5 within the bottom die 3 is selected in terms of size and dimensions, such that the device 6 can be accommodated therein. The depth of the seat there corresponds to the height of device 6, so that the surface 3*b* of bottom die 3 connects to the surface 6*a* of device 6 at the same level. This means that the surfaces 6*a*, 3*b* of device and bottom die together form a flat plane of the same surface.

Device 6 is received in a force-fit manner in seat 5, so that only a motion along the height of the device is possible. Other joining techniques are of course also possible, which do allow a modification/displacement along the height of device 6 though holding device 6 in its position. In addition to a force-fit, also a positive-fit and/or a positive substance-fit connection is possible.

Device 6 in the illustrated embodiment comprises a base plate 7 on which piezo-electric actuators 8 are disposed. The piezoelectric actuators extend at a right angle to base plate 7, where they are arranged with one end on base plate 7 and with another end on an adapter 9. Adapter 9 is supported on base plate 7 via a frame 10. Base plate 7, frame 10 and adapter 9 together form a casing in which the piezoelectric actuators 8 are encapsulated. The encapsulation or the casing has the advantage that device 6 with its piezoelectric actuators 8 is protected from oil, grease or dirt, for example.

Adapter 9 comprises a fastening region 9*a* and an oscillation or movable region 9*b*. A flexure hinge 11 is located between the two regions. This allows a relative motion between the fastening region and the oscillation region.

A flexure hinge 11 is not a conventional joint; the mobility with a flexure hinge is instead based on the principle of elastostatics. The function of the flexure hinge is ensured by a region of reduced flexural rigidity, which connects the two adjoining regions of higher flexural rigidity to each other. In other words, as shown in FIG. 1, a flexure hinge is a cross-sectional narrowing in a component, namely as in presently illustrated adapter 9.

Due to the fact that piezoelectric actuators comprise piezoelectric ceramic and also have similar fracture behavior like ceramic, device 6 additionally comprises two stops 12*a* and 12*b* which limit movement of the movable region 9*b* of adapter 9 in the direction of base plate 7. The piezoelectric actuators can thereby be protected against mechanical overload.

The one stop 12*a* is there formed as a shoulder on frame 10. The underside of adapter 9 can rest thereon without the piezoelectric actuators being further compressed in the direction of the base plate.

The same applies to stop 12*b* which is formed similar to a piezoelectric actuator 8, but is produced from similar material as frame 10 or base plate 7, so that it also prevents movement of the movable region 9*b* of adapter 9 in the direction of base plate 7. A minimum distance between the adapter and the base plate can be set in this manner.

Adapter 9 or fastening region 9*a* is connected in a force-fit manner via frame 10 to base plate 7. This can be realized, for example, by a bolted connection. Other types of connections, such as welding, are of course possible.

Device 6 furthermore comprises a die insert 14, which is formed similar to a cup and in the depression of which a force diversion surface 13, adapter 9, frame 10, and base plate 7 are received.

A force flow is generated by use of this configuration which, starting from the generators, the piezoelectric actuators, acts upon adapter 9 or upon its oscillation region 9*b* and then upon force diversion surface 13.

By supporting actuators 8 on base plate 7, oscillation region 9*b* and force diversion surface 13 move upwardly. The force flow furthermore flows from force diversion surface 13 toward die insert 14, which is thereby raised from seat 5. The forces generated or the force flow thereby presses die insert 14 against sheet metal plate 4. Consequently, in the region of device 6 or in the region of die insert 14, sheet metal plate 4 is pressed against hold-down clamp 2*a* with a force higher than in the regions between hold-down clamp 2*a* and die plate 3*a*, in which no device 6 is disposed.

The advantage of generating an additional force at a particular location, between hold-down clamp 2 and die plate 3*a* or in the flange of the workpiece or the sheet metal plate located between the draw ring and the hold-down clamp, is controlling the feed or the inflow of the flange into the die plate.

In other words, due to the force of hold-down clamp 2*a*, adjustable in the forming process in the portion in which device 6 is arranged, pressure can be exerted onto sheet metal plate 4, which changes the flow characteristics of the sheet metal material in the portion subjected to the pressure. The increased pressure influences the flow characteristics in such a manner that an increased level of friction is generated, particularly in the region between sheet metal plate 4 and top die 2 or hold-down clamp 2*a* and also between sheet metal plate 4 and bottom die 3 or die plate 3*a*.

The flow characteristics of the regions of sheet metal plate 4 located around this portion are thereby of course also influenced. Because, while in one region the flow is prevented by a higher holding force, more material flows from other surrounding regions. Consequently, the flow characteristics of sheet metal plate 4 or its material can be controlled during a deep drawing process by the skillful arrangement of device 6.

FIG. 1 also shows that seat 5 within die insert 14 has a depth that enables device 6 to be accommodated entirely therein. In the present example, die insert 14 is even configured such that its height corresponds exactly to the height of seat 5.

The force diversion surface 13 therefore serves as a fitting piece adjusting the correct height of base plate 7, frame 10, adapter 9, and force diversion surface 13 to the exact depth of the cup of die insert 14.

In the event that die insert 14 does not have the exact depth of seat 5, the height of device 6 can be adapted by use of force diversion surface 13 to the depth of seat 5, i.e. the distance from the bottom of seat 5 to the upper edge of seat 5. A planar surface between surface 3*b* of bottom die 3 and surface 6*a* of device 6 can thereby be created, or surfaces 6*a* and 3*b* can in this manner be made to connect at the same level.

The piezoelectric actuators 8 are connected to a controller (not shown) that allows the actuators to expand or contract.

In the event of actuation of piezoelectric actuators 8 for expansion, i.e. elongation, a force acts upon the moving region 9*b* of adapter 9, whereby the latter is spaced from base plate 7. Due to the increase of the spacing between adapter 9 and base plate 7, an additional holding force is transmitted via force diversion surface 13 onto die insert 14, which presses sheet metal plate 4 in the region of its extension against top die 2 or against hold-down clamp 2*a*. In this manner, sheet metal plate 4 is held during deep drawing with a greater force between hold-down clamp 2*a* and device 6 or die insert 14, whereby the flow of material into the die plate mold caused by a punch (not shown) can be manipulated. It is possible thereby to relieve regions having high deforming work.

Advantageously for this, device 6 is arranged in the vicinity of such a region. Particularly preferably, at least two such devices are arranged adjacent to a region having increased deforming work, which are located in particular at corner areas. A so-called tear in the deep-drawn mold can be prevented in this manner.

FIG. 1 also shows that piezoelectric actuators 8 are arranged consecutively. It is shown in the specific view of FIG. 1 that actuators 8 are arranged in a row. Also, further piezoelectric actuators are located behind the illustrated actuators 8, so that in total, an arrangement in rows and columns of piezoelectric actuators 8 on base plate 7 arises.

Figure 2:
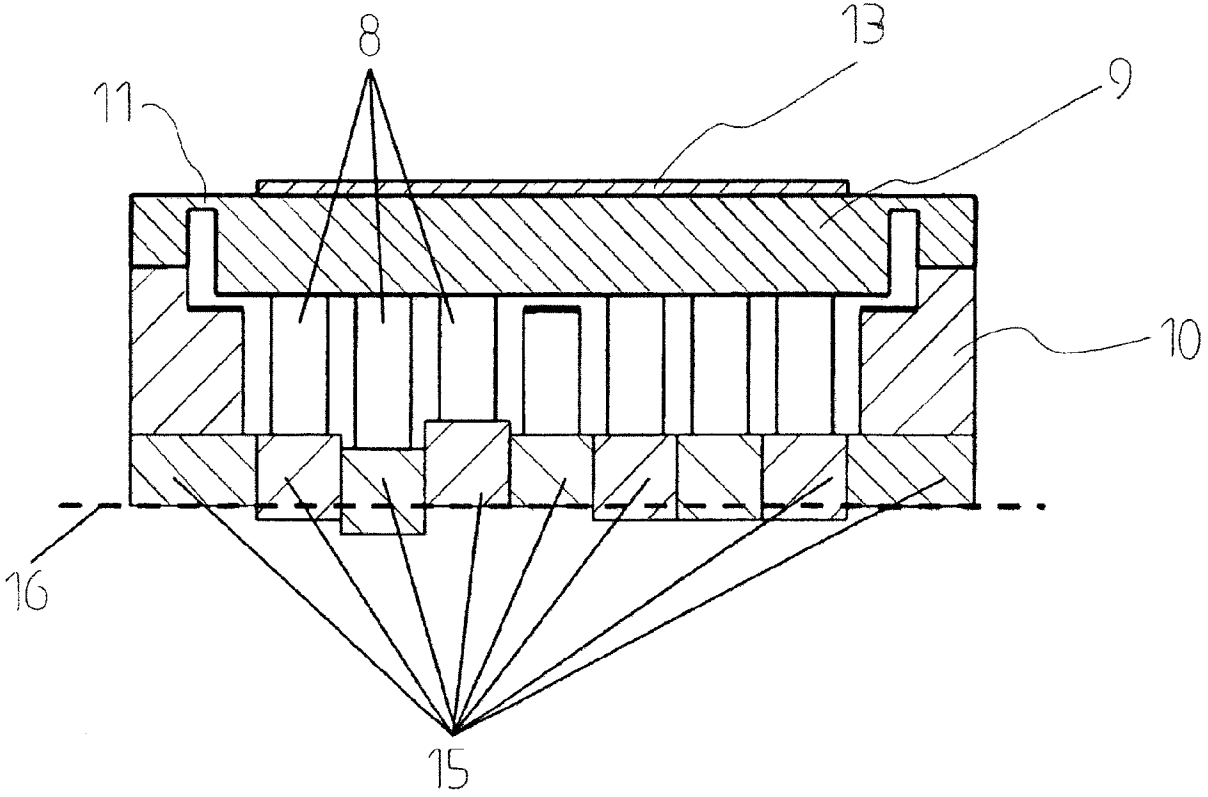
FIG. 2 is a schematic, lateral sectional view of a deep drawing die according to a second embodiment of the invention.

FIG. 2 shows a further embodiment of the invention, which is identical to the one previously presented in FIG. 1, but with the difference that base plate 7 is built up of various modules 15, i.e. is modular.

The starting point for the modular structure is that piezoelectric actuators 8, after polarization completing the essential manufacturing steps for initiating the electromechanical properties, do not exhibit uniform length. In an arrangement in rows and columns, selection of the piezoelectric actuators according to length and their division into classes can be necessary to homogenize the distribution of forces.

This means that, for the use of many classes, it is proposed to set up rows of actuators using actuators of one class, i.e. having the same length and the same expandability, on a module of a strip-shaped base plate and to assemble it, as shown in FIG. 2, to form a base plate 7.

The individual modules 15 forming base plate 7 are connected to each other such that they are connected in a force-fit manner, for example by bolts (not shown).

Here, the bolt connection of the strip-shaped modules is a viable solution and is effected in that all actuators 8 uniformly abut adapter 9. Subsequent processing of the undersides of the assembled strip-shaped modules 15 results in the contact surface 16 being plane-parallel to the connection plane of the piezoelectric actuators for support in deep drawing die 1. Grinding over piezoelectric actuators 8 as an alternative solution is problematic, in particular due to the effort for preventing mechanical stress and also due to the risk of contamination.

As shown in FIG. 2, the connected modules 15—as already mentioned—have a different height profile which results from the different lengths of piezoelectric actuators 8. Nevertheless, in order to obtain a planar surface on the underside of device 6, it is possible to machine the uneven underside of modules 15 and base plate 7 by use of a milling cutter or a grinding machine, such that a planar surface is created along indicated contact surface 16.

A further option according to the invention for creating a common planar underside of the joined strip-shaped base plates is leveling by use of a high-strength casting compound (not shown). Here, after connecting the individual modules to form a base plate 7, the base plate is inserted in a mold into which a casting compound is introduced to create a planar contact surface.

In both cases described, device 6 comprises die insert 14, force diversion surface 13, adapter 9, frame 10, and base plate 7, whereby the distance created by the piezoelectric actuators 8 or the holding force generated is transmitted directly onto sheet metal plate 4.

It is instead possible that the device comprise merely adapter 9, frame 10 and base plate 7. However, the holding force generated is then transmitted indirectly onto sheet metal plate 4 via force diversion surface 13 and die insert 14.

The invention relates to a deep drawing die having a top die and a bottom die, wherein the top die has a hold-down clamp and the bottom die has a die plate, and wherein at least one device is arranged in a flange region, by which the distance between hold-down clamp and die plate can be modified in portions or partially.

The invention further relates to a method for deep drawing a workpiece with a deep drawing die, wherein a workpiece is inserted between a top die and a bottom die and deep-drawn by closing the top and bottom dies, and wherein at least one actuator is controlled to generate a holding force during deep drawing.

Essentially, the invention presented controls the flange feed of a workpiece in the tool by pressure distributions which are adjustable in the forming process. By selectively increasing forces in the flange feed at selected locations between hold-down clamp and die plate, it is possible to control the flow of material into the die plate during deep drawing. Using this control, it is possible to relieve the load on regions having high deforming work, so that tears or cracks at these points in the finished component can be prevented. This involves increasing the friction between die plate and plate or between plate and hold-down clamp by generating holding forces, as a result of which the material is held fast and prevented from flowing at this location.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A deep drawing die comprising a top die having a hold-down clamp configured to contact one surface of a workpiece to be deep-drawn, a bottom die having a die plate configured to contact another surface of the workpiece, and a device arranged in at least one portion between the hold-down clamp and the die plate, said device comprising a die insert and at least one actuator acting upon said die insert for modifying a distance between the hold-down clamp and the die insert at the at least one portion, wherein the device is configured to generate a holding force and comprises a base plate and an adapter, wherein the at least one actuator is arranged between the adapter and the base plate, wherein the holding force can be controlled, wherein the adapter comprises at least one flexure hinge between a fastening region and an oscillation region of the adapter, and wherein both regions are movable relative to each other.

2. The deep drawing die according to claim 1, wherein the top die and/or the bottom die comprises a seat in which the device is held in a positive-fit, force-fit, and/or positive substance-fit manner.

3. The deep drawing die according to claim 1, wherein the device is arranged within at least one of the top die and the bottom die.

4. The deep drawing die according to claim 1, wherein the actuator is a piezo-electric actuator.

5. The deep drawing die according to claim 1, wherein the device further comprises at least one stop setting a minimum distance between adapter and base plate.

6. The deep drawing die according to claim 5, wherein the base plate is composed of modules.

7. The deep drawing die according to claim 6, wherein the modules have a strip-shaped form.

8. The deep drawing die according to claim 7, wherein the modules are connectable to each other.

9. The deep drawing die according to claim 1, wherein each of the at least one actuator comprises a series resistor that protects against rapid discharge and/or disconnects a defective actuator from a line supplying electric power to each actuator.

10. A method for deep drawing a workpiece with a deep drawing die according to claim 1, the method comprising the steps of:

a) inserting the workpiece between the top die having the hold-down clamp configured to contact one surface of a workpiece and the bottom die having the die plate configured to contact another surface of the workpiece;

b) closing the top and the bottom dies to deep draw the workpiece; and c) introducing a holding force during the deep drawing by the at least one actuator which is arranged in at least one portion between the hold-down clamp and the die plate.

11. The method according to claim 10, wherein the device is arranged in at least one portion between the top die and the bottom die, and wherein the device modifies the distance between the top die and the bottom die in the at least one portion.

* * * * *